US012564281B2

(12) United States Patent
Platt et al.

(10) Patent No.: US 12,564,281 B2
(45) Date of Patent: Mar. 3, 2026

(54) STACKABLE SPACE SAVING SYSTEM AND METHOD OF USE

(71) Applicants: James Richard Platt, Manor, PA (US); Rebecca Lynn Nesbitt, Manor, PA (US)

(72) Inventors: James Richard Platt, Manor, PA (US); Rebecca Lynn Nesbitt, Manor, PA (US)

( * ) Notice: Subject to any disclaimer, the term of this patent is extended or adjusted under 35 U.S.C. 154(b) by 60 days.

(21) Appl. No.: 18/370,834

(22) Filed: Sep. 20, 2023

(65) Prior Publication Data

US 2024/0023740 A1 Jan. 25, 2024

Related U.S. Application Data

(63) Continuation-in-part of application No. 17/180,267, filed on Feb. 19, 2021, now abandoned, which is a continuation-in-part of application No. 15/998,122, filed on Jul. 2, 2018, now abandoned.

(60) Provisional application No. 62/604,400, filed on Jul. 5, 2017.

(51) Int. Cl.

| | |
|---|---|
| ***A47G 19/30*** | (2006.01) |
| ***A47F 5/06*** | (2006.01) |
| ***A47F 7/00*** | (2006.01) |
| ***B65D 21/02*** | (2006.01) |
| ***B65D 21/04*** | (2006.01) |
| ***B65D 21/06*** | (2006.01) |
| *A47G 19/23* | (2006.01) |
| *B65D 21/08* | (2006.01) |

(52) U.S. Cl.

CPC ..... *A47G 19/30* (2013.01); *A47F 5/06* (2013.01); *A47F 7/0071* (2013.01); *B65D 21/0209* (2013.01); *B65D 21/046* (2013.01); *B65D 21/06* (2013.01); *A47G 19/23* (2013.01); *A47G 2400/08* (2013.01); *B65D 21/086* (2013.01)

(58) Field of Classification Search

CPC .. B65D 21/086; B65D 21/06; B65D 21/0209; B65D 21/046; B65D 21/043; B65D 21/045; A47F 5/06; A47F 7/0071; A47F 5/04; A47F 47/16; A47F 5/05; A47G 19/23

USPC ..... 206/507, 514, 509, 503, 505, 501, 499; D7/558, 505, 555; D6/677.3; 211/196, 211/85.4, 205

See application file for complete search history.

(56) References Cited

U.S. PATENT DOCUMENTS 1,928,799 A * 10/1933 Stevens ..... A01G 9/023 D23/201
3,951,079 A * 4/1976 Tolleson ..... A47F 5/02 108/94

(Continued)

*Primary Examiner* — Don M Anderson
*Assistant Examiner* — Jennifer Castriotta
(74) *Attorney, Agent, or Firm* — Gwen R. Acker Wood; Acker Wood IP Law, LLC

(57) ABSTRACT

The present invention provides a plurality of stackable, space saving system of bowls which may form a three-or four-tiered tower of bowls that are stably locked upright in place using a twist and lock mechanism located on each of the bowls. The bowls are stackable due to having sdifferent-sized, molded, elongated elliptical members that telescopically fit one into the other so that the tower is collapsible into a compact, space-saving configuration. In addition, each of the plurality of bowls may be used singly with an accompanying airtight lid.

20 Claims, 6 Drawing Sheets

(56) References Cited

U.S. PATENT DOCUMENTS

| | | | | | |
|---|---|---|---|---|---|
| 5,392,948 | A * | 2/1995 | McEntee | A47J 43/0727 | 222/572 |
| D421,549 | S * | 3/2000 | Hints | D7/505 | |
| D560,974 | S * | 2/2008 | Goode | D7/558 | |
| D707,493 | S * | 6/2014 | Frei | D7/558 | |
| 9,363,952 | B2 * | 6/2016 | Zak | B65D 21/0238 | |
| D782,361 | S * | 3/2017 | Williams | D11/143 | |
| 2012/0219685 | A1 * | 8/2012 | Radow | A47G 19/22 | 426/420 |
| 2014/0339185 | A1 * | 11/2014 | Ellison | A47B 87/0215 | 211/119.003 |

* cited by examiner

STACKABLE SPACE SAVING SYSTEM AND METHOD OF USE

CROSS REFERENCE TO RELATED APPLICATIONS

This application is a continuation-in-part of U.S. application Ser. No. 17,180,267, filed Feb. 19, 2021, which is a continuation-in-part of U.S. application Ser. No. 15/998,122, filed Jul. 2, 2018, which claims priority to U.S. Provisional Application No. 62/604,400, filed Jul. 5, 2017, all of which are incorporated herein by reference in their entirety.

FIELD OF THE INVENTION

The present invention relates to kitchenware and, in particular, to a plurality of stackable bowls/strainers which use a twist and lock mechanism, removable members, and center openings to lock the bowls in an upright position forming a tower to accommodate a large assortment of food, or to collapse the bowls into a space-saving, compact configuration.

BACKGROUND OF THE INVENTION

When food is served, whether on a countertop, a dining room table, a coffee table, at a restaurant buffet, or on a banquet table, the food typically is spread out which oftentimes results in undue cluttering and lack of space. This is common in large families, where the dinner table may become cluttered due to the lack of space to accommodate the food being served, resulting in spilt food and drinks. This is especially the case at holidays parties, when large groups of people are gathered around the food table.

There exists a need, therefore, for a solution to the clutter and lack of space that is all too common when serving a variety of food to family or guests.

SUMMARY OF THE INVENTION

The present invention fulfills this need by providing a stackable, space saving system and method of use. The stackable, space saving system forms a tower which is collapsible to conserve space while cleaning, preparing, serving and/or storing food or items. In addition, the stackable, space saving system tower eliminates cluttered countertops and tables. At the dinner table, the stackable, space saving system can serve an entire three course meal while taking up no more than one-third of table space.

The stackable, space saving system comprises a plurality of bowls in which the plurality of bowls comprise a foundation bowl having a front side, a back side, and a foundation elongated elliptical member having a top end and a bottom end. The foundation elongated elliptical member is permanently attached to and positioned through a foundation center elliptical opening of the foundation bowl, wherein the foundation elongated elliptical member is smaller in circumference than a center elliptical opening circumference located in each of the other plurality of bowls.

The plurality of bowls also comprise a plurality of middle bowls having a smaller diameter than the foundation bowl and each of the plurality of middle bowls has a different diameter from one another. Each of the plurality of middle bowls has a front side, a back side, and a solid, elongated elliptical member having a top end and a bottom end. Each of the elongated elliptical members is permanently attached to and positioned through a center elliptical opening of each of the plurality of middle bowls. Each of the plurality of middle bowls has an elliptical recessed area located on the back side of each bowls, in which the elliptical recessed area bisects the center elliptical opening along its short axis. Each of the elongated elliptical members has a circumference that is smaller than the center elliptical opening circumference of an adjacent middle bowl so that the elongated elliptical member may be inserted into the adjacent middle bowl. In addition, the shape and circumference of the center elliptical opening and the elliptical recessed area on each middle plate have identical shapes and circumferences.

The plurality of bowls further comprise a sectional bowl having a front side, a back side, a plurality of walls dividing up the front side into a plurality of sections, a sectional elliptical central opening, and a sectional elliptical recessed area located on the back side of the bowl which bisects the sectional elliptical central opening along its short axis. The sectional elliptical central opening has a circumference that is larger than the elongated elliptical member of one of the plurality of middle bowls located underneath and adjacent to the sectional bowl so that it may be inserted into the sectional elliptical central opening. In addition, the sectional elliptical central opening and the sectional elliptical recessed area have identical elliptical shapes and circumferences.

Each of the bowls locks into an adjacent bowl by a twist and lock configuration in which an elongated elliptical member inserts into the back side of an adjacent bowl by being placed in the center elliptical opening of the adjacent bowl and then turned 90 degrees to lock into the elliptical recessed area of the adjacent bowl. In addition, each of the plurality of bowls has a diameter that is smaller than the diameter of a bowl adjacent to and positioned below it.

Each elongated elliptical member is configured to slide into an elongated elliptical member of a bowl located directly above and adjacent thereto. This is accomplished by having each of the elongated elliptical members differ slightly in its circumference, i.e., each bowl has an elongated elliptical member that is circumferentially smaller than a bowl positioned directly above and adjacent thereto.

Each of the plurality of bowls are configured to be used alone as well as capable of being assembled into the stackable, space saving tower system. In addition, each of the plurality of bowls has a suitably sized removable air-tight lid.

BRIEF DESCRIPTION OF THE DRAWINGS

For the present disclosure to be easily understood and readily practiced, the present disclosure will now be described for purposes of illustration and not limitation in connection with the following figures, in which.

DETAILED DESCRIPTION OF THE INVENTION

Figure 1:
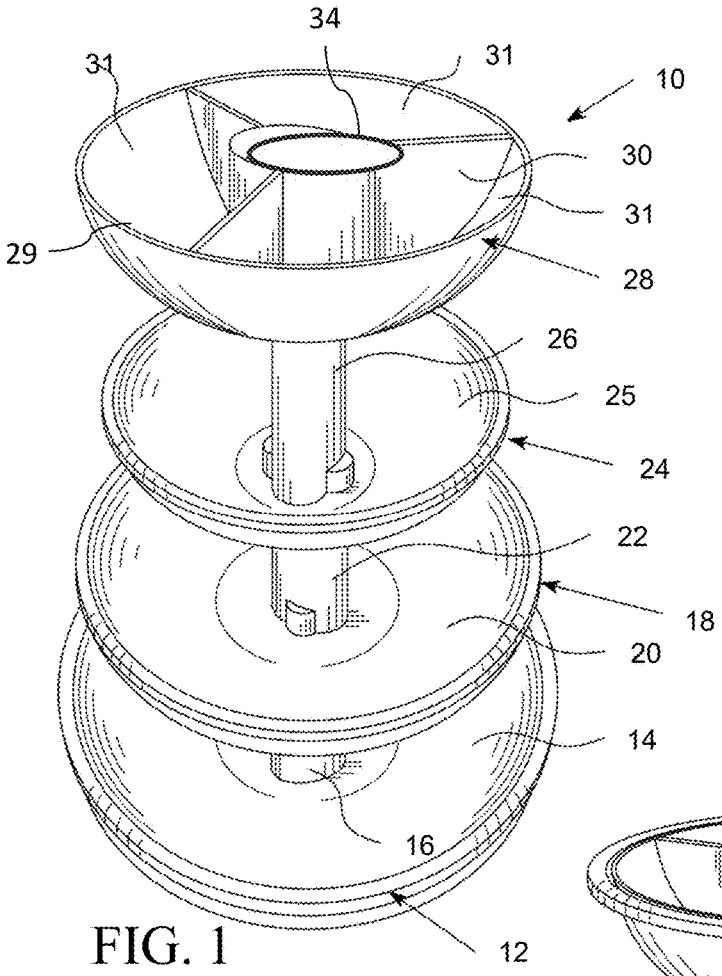
FIG. 1 is a perspective view of the stackable space saving system in which a four-tiered tower is shown.
Figure 2:
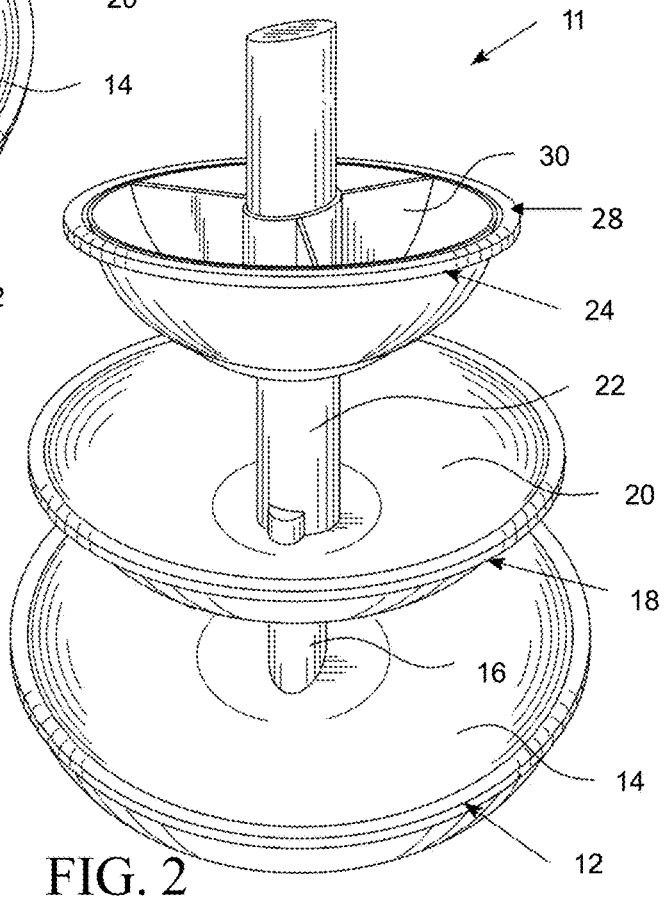
FIG. 2 is a perspective view of the stackable space saving system in which a three-tiered tower is shown and a removable elongated elliptical member is inserted in the elliptical central opening of the sectional bowl
Figure 3:
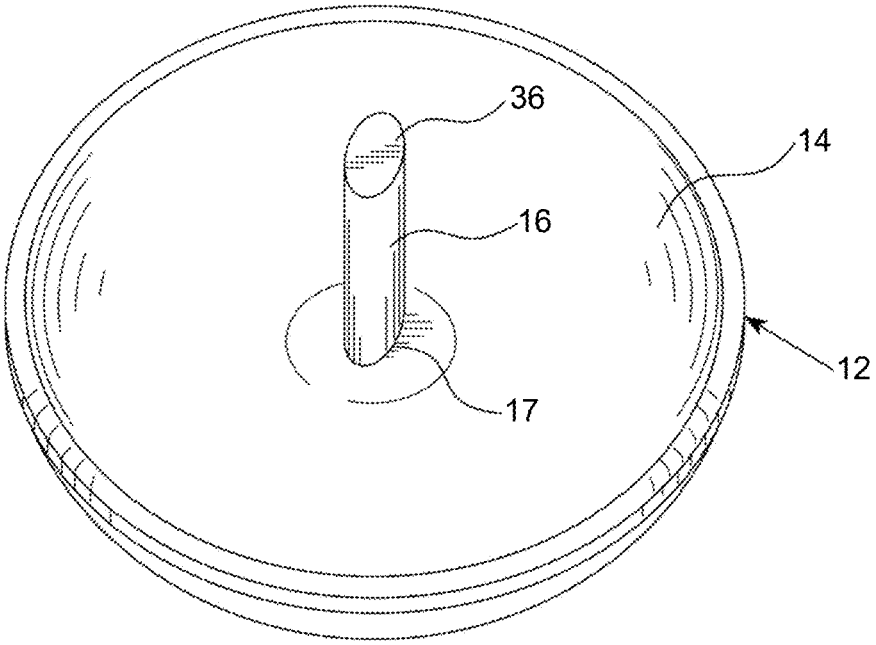
FIG. 3 is a perspective front view of the foundation bowl showing its elongated elliptical member.
Figure 4:
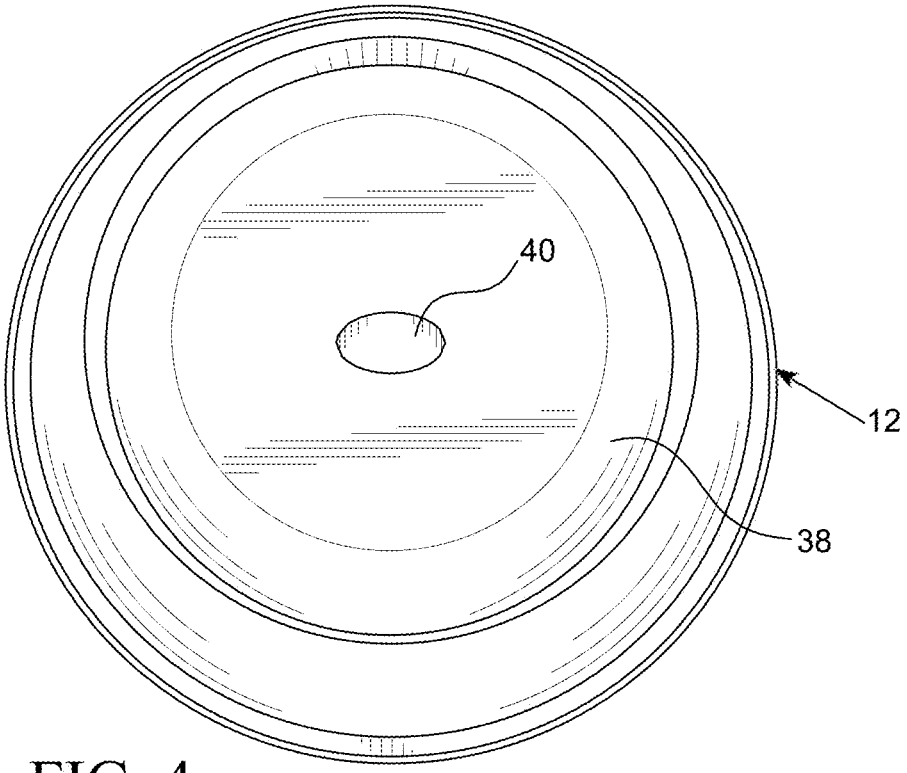
FIG. 4 is a rear view of the foundation bowl showing its center elliptical opening.

As used herein, the words "collapsed" and "collapsible" are defined as having each of the bowls of the invention sitting directly on top of an adjacent bowl, and having the bowls capable of going from an upright position to form a tower to a compressed position in which each of the bowls sit directly on top of an adjacent bowl, respectively.

As used herein, "elongated elliptical member" is meant to be interchangeable with "member."

As used herein, "foundation bowl" is meant to be interchangeable with "bottommost bowl" or "bottom bowl."

As used herein the word "tower" is defined as the stackable space saving system configured in an upright position.

Embodiments of the invention are discussed in detail below with reference to the figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc. Moreover, the ordinary and customary meaning of terms like "substantially" includes "reasonably close to, nearly, almost, about", connoting a term of approximation. Depending on its usage, the word "substantially" can denote either language of approximation or language of magnitude.

The present invention provides a stackable, space saving system of food bowls comprised of a plurality of bowls stacked one above the other with elongated elliptical members separating each bowl to form a tower. The bottom bowl of the plurality of bowls has the largest diameter and each adjacent bowl going in an upwardly direction has a diameter that is smaller than the bowl directly below. relative to the bowl below.

In an embodiment, as shown in FIGS. 1-4, there is provided a stackable, space saving system forming a four-tiered tower 10 comprised of a bottom bowl, referred to as a foundation bowl 12, a second bowl 18, a third bowl 24 and a fourth bowl, referred to as a sectional bowl 28.

In another embodiment, the stackable, space saving system forms a three-tiered tower 11 comprised of the foundation bowl 12, the second bowl 18, with the sectional bowl 28 sitting within the third bowl 24.

The foundation bowl has a front side 14, a back side 38 (shown in FIG. 4), and a foundation elongated elliptical member 16 having a top end 36 and a bottom end 17. The foundation elongated elliptical member 16 is permanently attached to and spans through a foundation center elliptical opening 40 of the foundation bowl 12 (shown in FIG. 4).

Figure 5:
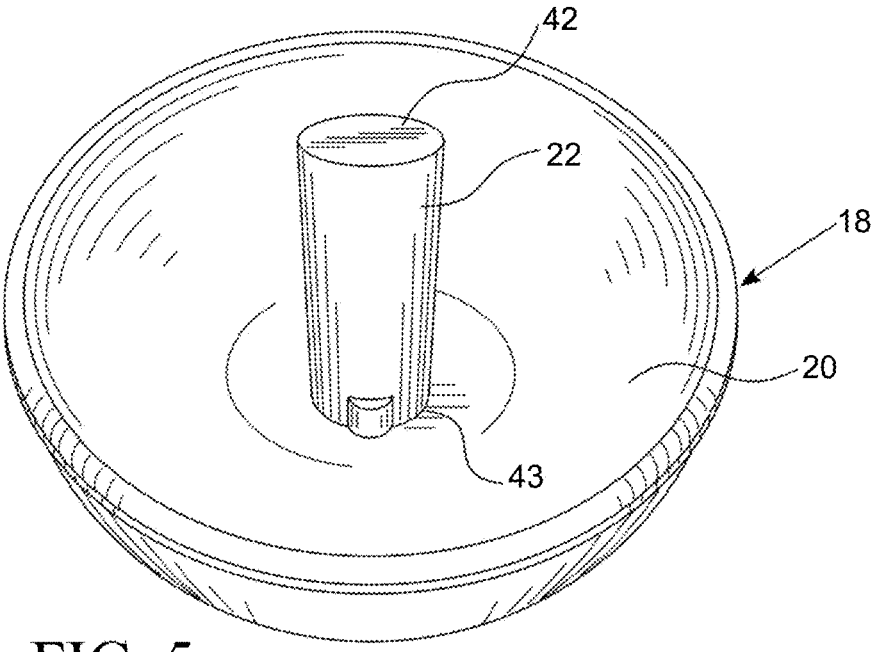
FIG. 5 is a perspective front view of the second bowl showing its elongated elliptical member.
Figure 6:
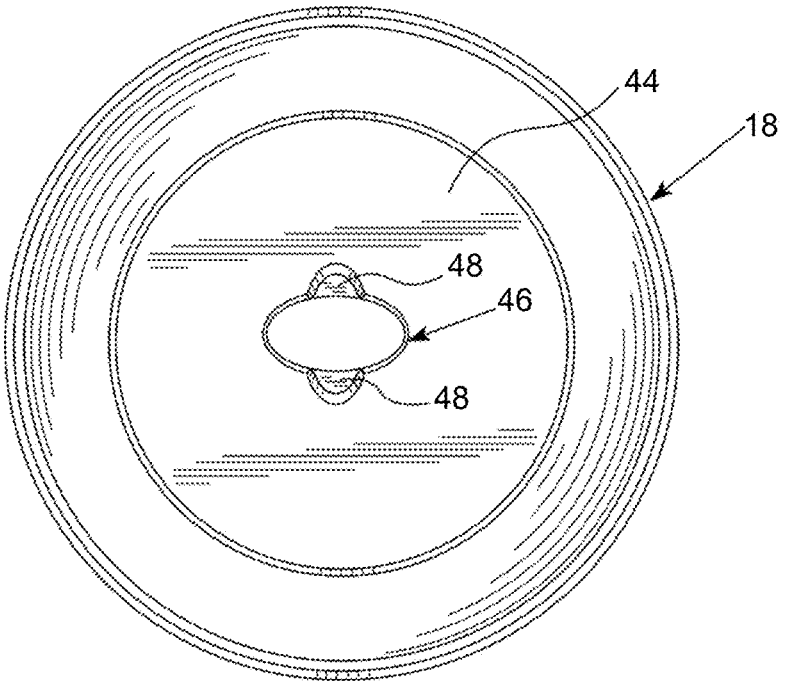
FIG. 6 is a rear view of the foundation bowl showing its center elliptical opening and its recessed elliptical area.

Referring now to FIGS. 5 and 6, the second bowl 18 has a front side 20, a back side 44, and a second, elongated elliptical member 22 having a top end 42 and a bottom end 43. The second, elongated elliptical member is permanently attached to and positioned through a second center elliptical opening 46 of the second bowl 18. On the back side 44 of the second bowl 18 there is an elliptical recessed area referred to as a "second" elliptical recessed area 48 which bisects the second center elliptical opening 46 along its short axis. The second center elliptical opening 46 has a circumference that is larger than the foundation elongated elliptical member 16 circumference so that the foundation elongated elliptical member 16 may be inserted into the second center elliptical opening 46. Both the second center elliptical opening 46 and the second elliptical recessed area 48 have identical shapes and circumferences.

Figure 7:
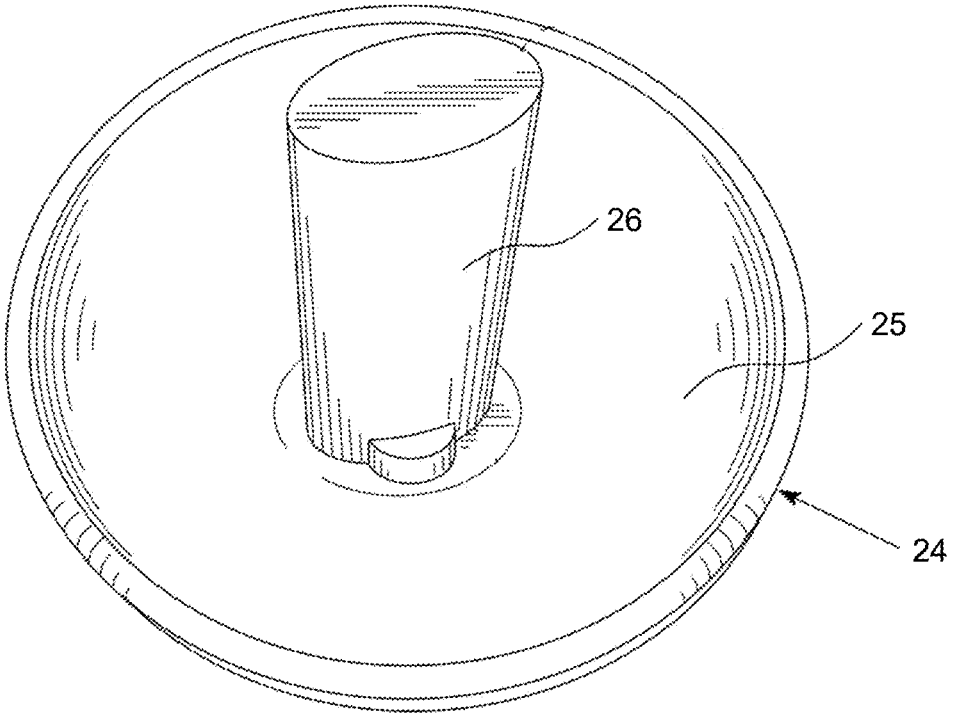
FIG. 7 is a perspective front view of the third bowl showing its elongated elliptical member.
Figure 8:
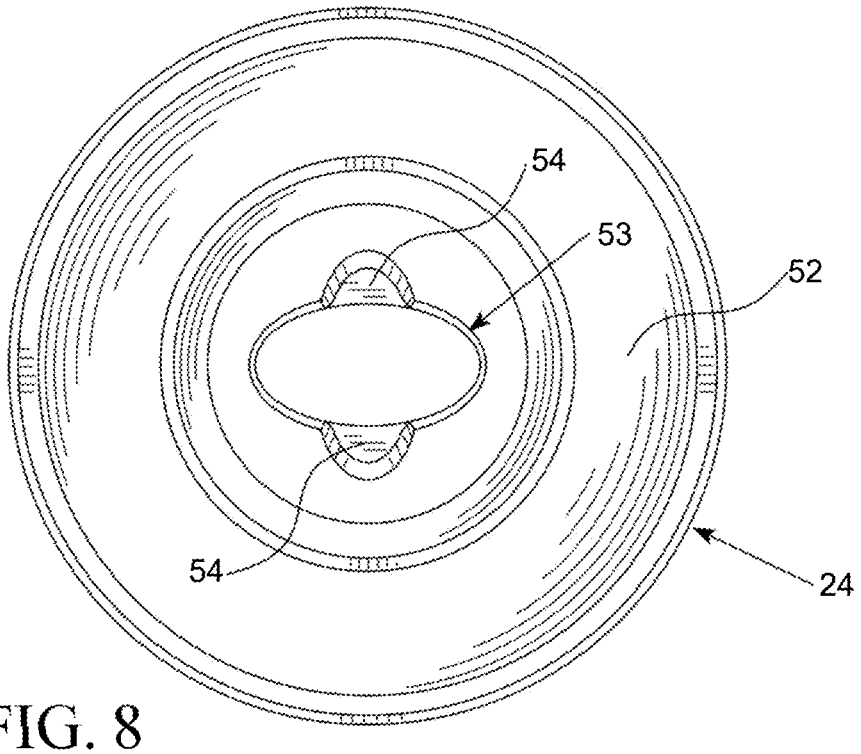
FIG. 8 is a rear view of the third bowl showing its center elliptical opening and its recessed elliptical area.

Referring now to FIGS. 7 and 8, a third bowl 24 having a front side 25, a back side 52, and a third hollow, elongated elliptical member having a top end and a bottom end. The third elongated elliptical member 26 is permanently attached to and positioned through a third center elliptical opening 53 of the third bowl 24. On the back side 52 of the third bowl 24 there is a third elliptical recessed area 54 which bisects the third center elliptical opening 53 along its short axis. The third center elliptical opening 53 has a circumference that is larger than the foundation elongated elliptical member 16 circumference to allow the second solid, elongated elliptical member 22 to be inserted therein. Both the third center elliptical opening 53 and the third elliptical recessed area 54 have identical elliptical shapes and circumferences.

Figure 9:
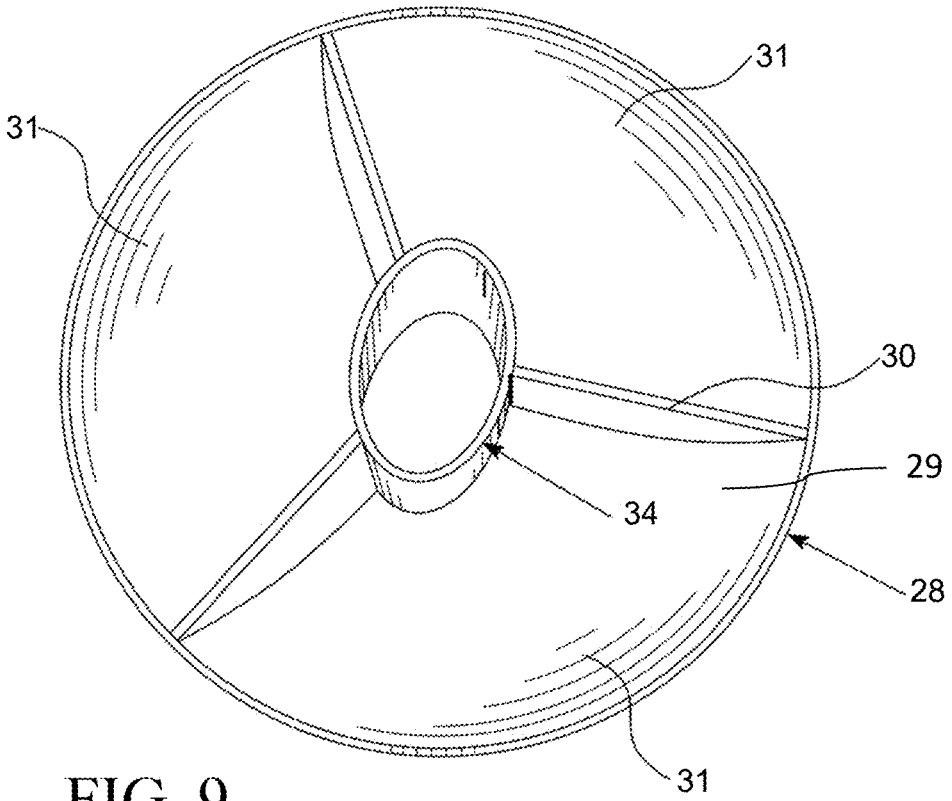
FIG. 9 is a front view of the sectional bowl showing its elliptical central opening and three dividing walls which form three sections.
Figure 10:
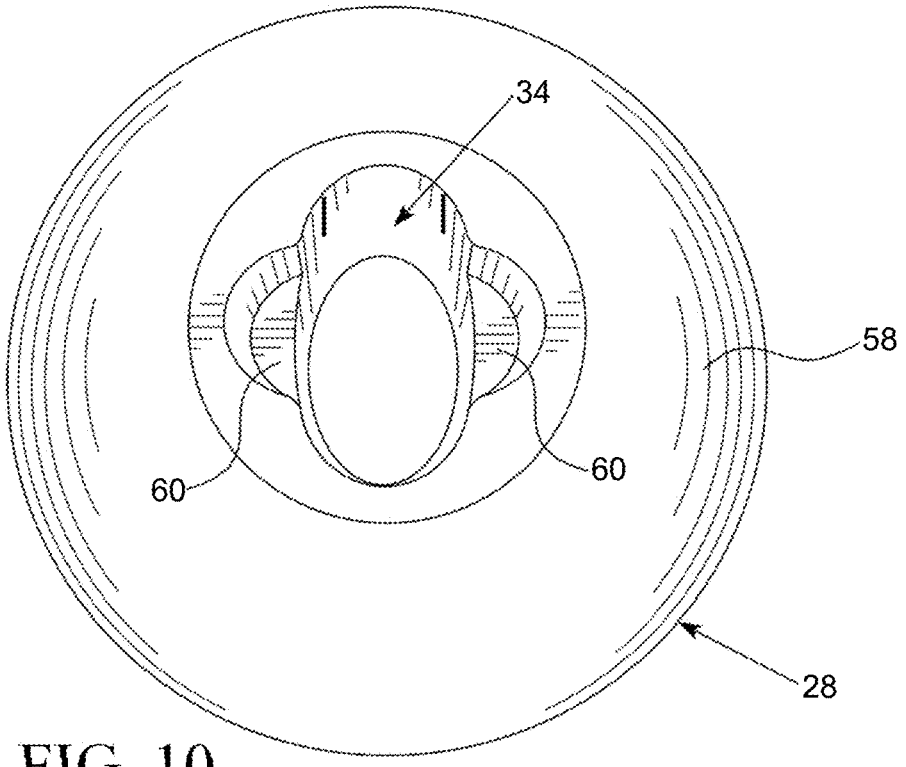
FIG. 10 is a rear view of the sectional bowl showing its center elliptical opening and its recessed elliptical area.
Figure 11:
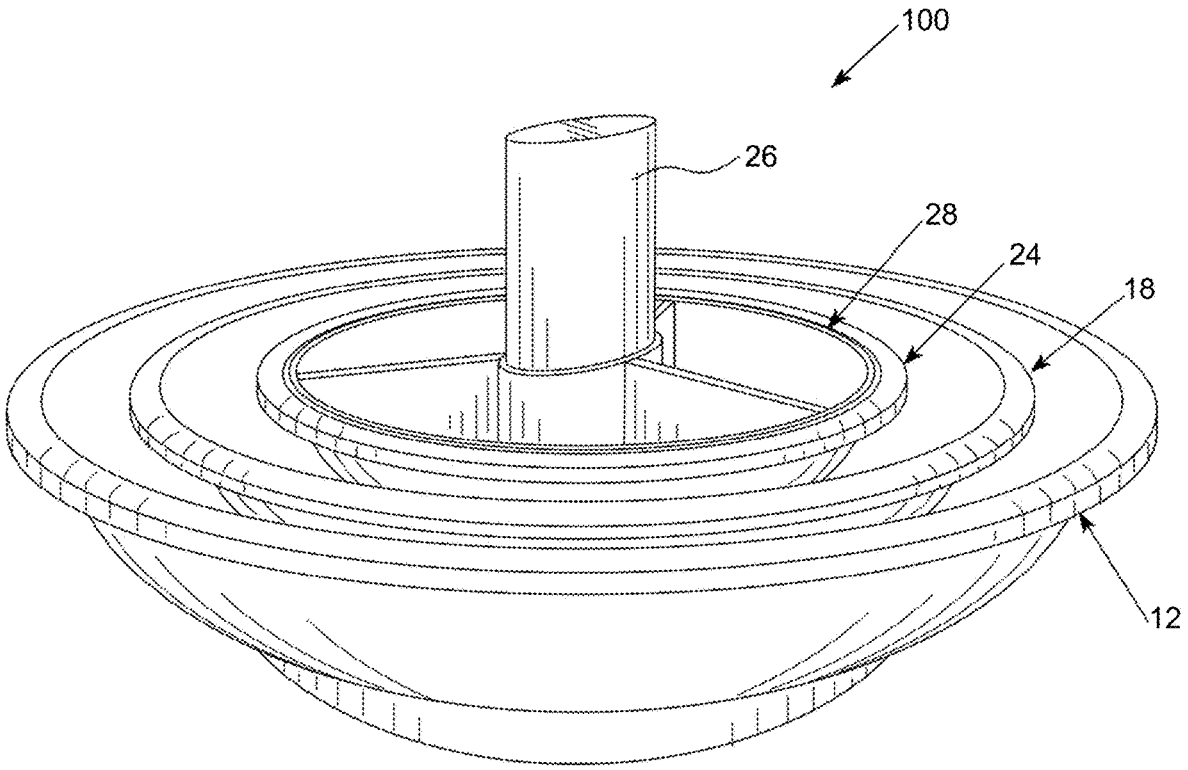
FIG. 11 is a perspective view of the stackable space saving system when collapsed.

Referring now to FIGS. 9 and 10, in an embodiment, the sectional bowl 28 has a front side 29, a back side 58, three dividing walls 30 which divide up the front side 29 into three sections 31, a sectional elliptical central opening 34, and a sectional elliptical recessed area 60 located on the back side 58 of the sectional bowl 28 which bisects the sectional elliptical central opening 34 along its short axis. The sectional elliptical central opening 34 has a circumference that is larger than the elongated elliptical member 26 of third bowl 24 located underneath and adjacent to the sectional bowl 28 so that it may be inserted into the sectional elliptical central opening 34. Both the sectional elliptical central opening 34 and the sectional elliptical recessed area 60 have identical elliptical shapes and circumferences.

In use, in an embodiment of the invention which comprises an upright, stable, four-tiered tower, the stackable, space saving system is assembled as follows. The second center elliptical opening of the second bowl is placed atop the top end of the elongated elliptical member of the foundation bowl. The second bowl then is rotated 90 degrees in either direction so that the foundation elongated elliptical member inserts into the elliptical recessed area of the second bowl, which locks the second bowl in place on top of the foundation elongated elliptical member of the foundation bowl. The third center elliptical opening of the third bowl is placed atop the top end of the second elongated elliptical member of the second bowl. The third bowl then is rotated 90 degrees in either direction so that the second, elongated elliptical member inserts into the elliptical recessed area of the third bowl which locks the third bowl in place on top of the second elongated elliptical member of the second bowl. The sectional elliptical central opening of the sectional bowl fits atop the top end of the third, elongated elliptical member of the third bowl. The sectional bowl then is rotated 90 degrees in either direction so that the third, elongated elliptical member inserts into the elliptical recessed area of the sectional bowl which locks the sectional bowl in place on top of the third elongated elliptical member of the third bowl. In this embodiment, a removable elliptical, elongated member (not shown), having substantially the same circumferential dimensions as the elliptical central opening of the sectional bowl, optionally may be inserted into the elliptical central opening of the sectional bowl so that the four-tiered tower may be transported using the removable elongated elliptical member as a handle.

In another embodiment of the invention which comprises an upright, stable, three-tiered tower, the stackable, space saving system is assembled as follows. The second center elliptical opening of the second bowl is placed atop the top end of the elongated elliptical member of the foundation bowl. The second bowl then is rotated 90 degrees in either direction so that the foundation elongated elliptical member inserts into the elliptical recessed area of the second bowl, which locks the second bowl in place on top of the foundation elongated elliptical member of the foundation bowl. The third center elliptical opening of the third bowl is placed atop the top end of the second elongated elliptical member of the second bowl. The third bowl then is rotated 90 degrees in either direction so that the second, elongated elliptical member inserts into the elliptical recessed area of the third bowl which locks the third bowl in place on top of the second elongated elliptical member of the second bowl. The third center elliptical member of the third bowl is inserted into the sectional central elliptical opening of the sectional bowl. In this embodiment, the third elongated elliptical member which has been inserted into center elliptical opening of the section bowl can be used as a handle for transport of the three-tiered tower.

In an embodiment of the invention, each of the elongated elliptical members are hollow having a closed top end and an opening on the bottom end to allow the underlying adjacent elongated elliptical member to slide therein.

When the stackable, space saving system of the invention is not in use, each bowl is collapsible into the bowl beneath it as follows. In the four-tiered embodiment of the invention, the sectional bowl is rotated 90 degrees to release the third elongated elliptical member from the sectional elliptical recessed area, then the sectional bowl is fitted over the third elongated elliptical member so that it slides over the third elongated elliptical member so that the sectional bowl sits atop the front side of the third bowl. Then, the third bowl is rotated 90 degrees to release the second elongated elliptical member from the third elliptical recessed area, the third bowl then is fitted over the second elongated elliptical member so that it slides over the second elongated elliptical member so that the third bowl sits atop the front side of the second bowl. Then, the second bowl is rotated 90 degrees to release the foundation elongated elliptical member from the second elliptical recessed area, the second bowl then is fitted over the foundation elongated elliptical member so that it slides over the foundation elongated elliptical member so that the second bowl sits atop the front side of the second bowl. FIG. 1I shows the stackable, space saving system four-tiered tower when completely collapsed. The only elongated elliptical member visible in this configuration is the third elongated elliptical member. Not seen in this configuration is the foundation elongated elliptical member that is inserted in the second elongated elliptical member and the second elongated elliptical member that is inserted in third elongated elliptical member.

The three-tiered tower collapses in the same manner, except that the sectional bowl is not unlocked from the third bowl because it sits within the interior of the third bowl.

The invention contemplates that the dimensions of each of its elements may vary in different embodiments to envision manufacturing larger towers or smaller towers, except that the dimensions of each of the elements in a single embodiment require that each element's dimensions are measured relative to each of the other elements in that single embodiment.

In an embodiment of the invention, each of the elliptical recessed areas has a depth of about 0.5 inches.

In an embodiment of the invention, the foundation bowl has a diameter of about 12 inches and is about 4.0 inches deep, the second bowl has a diameter of about 10 inches and is about 3.5 inches deep, the third bowl has a diameter of about 7 inches and is about 3.0 inches deep, and the sectional bowl has a diameter and a depth which allows is substantially the same but somewhat smaller so that it fits snugly within the third bowl.

In an embodiment, the length of each of the elongated elliptical members is about 6.0 inches.

The stackable, space saving system may be fabricated from any suitable material which includes, without limitation, high-density polyethylene (HDPE) plastic, low-density polyethylene (LDPE) plastic, polyethylene terephthalate (PET/PETE), food-grade polypropylene (PP), polycarbonate (PC), acrylic, nylon acrylic or nylon.

While the invention has been particularly shown and described with reference to embodiments described above, it will be understood by those skilled in the art that various alterations in form and detail may be made therein without departing from the spirit and scope of the invention, as defined by the appended claims.

What is claimed is:

1. A stackable space saving system, comprising:

a plurality of bowls, said plurality of bowls comprising:

a foundation bowl having a front side, a back side, and a foundation elongated elliptical member having a top end and a bottom end, said foundation elongated elliptical member permanently attached to and positioned through a foundation center elliptical opening of the foundation bowl, wherein the foundation elongated elliptical member is smaller in circumference than a center elliptical opening circumference located in another one of the plurality of bowls;

a plurality of middle bowls having smaller diameters than the foundation bowl and each of the middle bowls having a different diameter from one another, each of the middle bowls having a front side, a back side, and an elongated elliptical member having a top end and a bottom end, each of said elongated elliptical members permanently attached to and positioned through a center elliptical opening of a respective one of the plurality of middle bowls, and an elliptical recessed area located on the back side of each of the plurality of middle bowls and bisecting the center elliptical opening along its short axis, wherein each of the elongated elliptical members has a circumference that is smaller than the center elliptical opening circumference of an adjacent middle bowl so that the elongated elliptical member may be inserted therein, wherein each middle bowl has a central elliptical opening and an elliptical recess area having identical shapes and circumferences on their respective bodies; and a sectional bowl having a front side, a back side, a plurality of walls dividing up the front side into a plurality of sections, a sectional elliptical central opening, and a sectional elliptical recessed area located on the back side of the sectional bowl and bisecting the sectional elliptical central opening along its short axis, wherein the sectional elliptical central opening has a circumference that is larger than the elongated elliptical member of one of the plurality of middle bowls located underneath and adjacent to the sectional bowl so that it may be inserted into the sectional elliptical central opening, wherein the sectional elliptical central opening and the sectional elliptical recessed area have identical elliptical shapes and circumferences, wherein each of the bowls has a different diameter, wherein each of the elongated elliptical members has a different circumference, and wherein each of the center elliptical openings has a different circumference.

2. The stackable space saving system of claim 1, wherein each of the elongated elliptical members are hollow with an opening on the bottom end and a closed top end.

3. The stackable space saving system of claim 2, wherein the plurality of bowls is comprised of a foundation bowl, a second bowl, a third bowl, and a sectional bowl.

4. The stackable space saving system of claim 3, wherein the second bowl has a front side, a back side, a second elongated elliptical member having a top end and a bottom end, said second elongated elliptical member permanently attached to and positioned through a second center elliptical opening of the second bowl, and a second elliptical recessed area located on the back side of the second bowl and bisecting the second center elliptical opening along its short axis, wherein the second center elliptical opening has a circumference that is larger than the foundation elongated elliptical member circumference so that the foundation elongated elliptical member may be inserted into the second center elliptical opening, wherein the second center elliptical opening and the second elliptical recessed area have identical shapes and circumferences.

5. The stackable space saving system of claim 4, wherein the third bowl has a front side, a back side, a third elongated elliptical member having a top end and a bottom end, said third elongated elliptical member permanently attached to and positioned through a third center elliptical opening of the third bowl, and a third elliptical recessed area located on the back side of the third bowl and bisecting the third center elliptical opening along its short axis, wherein the third center elliptical opening has a circumference that is larger than the second elongated elliptical member circumference to allow the second, elongated elliptical member of the second bowl to be inserted into the third center elliptical opening, wherein the third center elliptical opening and the third elliptical recessed area have identical elliptical shapes and circumferences.

6. The stackable space saving system of claim 5, wherein the third elongated elliptical member of the third bowl has a circumference that is smaller than the sectional elliptical central opening circumference so that the third solid, elongated elliptical member of the third bowl may be inserted into the sectional elliptical central opening.

7. The stackable space saving system of claim 6, wherein the stackable space saving system is configured to be upright or collapsible, wherein when it is upright it forms a three-tiered or a four-tiered tower.

8. The stackable space saving system of claim 7, wherein the second center elliptical opening of the second bowl fits atop the top end of the elongated elliptical member of the foundation bowl, wherein when the second bowl is rotated 90 degrees in either direction, the foundation elongated elliptical member inserts into the second elliptical recessed area so that the second bowl is locked in place atop the foundation bowl.

9. The stackable space saving system of claim 8, wherein the third center elliptical opening of the third bowl fits atop the top end of the second elongated elliptical member of the second bowl, wherein when the third bowl is rotated 90 degrees in either direction, the second elongated elliptical member inserts into the third elliptical recessed area of the third bowl so that the third bowl is locked in place atop the second bowl.

10. The stackable space saving system of claim 9, wherein the sectional elliptical central opening of the sectional bowl fits atop the top end of the third elongated elliptical member of the third bowl, wherein when the sectional bowl is rotated 90 degrees in either direction, the third elongated elliptical member of the third bowl inserts into the sectional elliptical recessed area of the sectional bowl so that the sectional bowl is locked in place atop the third bowl.

11. The stackable space saving system of claim 10, wherein when the second bowl is locked in place above the foundation bowl, the third bowl is locked in place above the second bowl, and the sectional bowl is locked in place above the third bowl, the bowls form a four-tiered tower.

12. The stackable space saving system of claim 11, wherein the four-tiered tower is collapsed by rotating the sectional bowl 90 degrees to unlock the third bowl from the sectional elliptical recessed area so that the sectional bowl sits on top of the front side of the third bowl, by rotating the third bowl 90 degrees to unlock the second bowl from the third elliptical recessed area so that third bowl sits on top of the front side of the second bowl, and by rotating the second bowl 90 degrees to unlock the foundation bowl from the second elliptical recessed area so that second bowl sits on top of the front side of the foundation bowl.

13. The stackable space saving system of claim 5, wherein the foundation bowl has a diameter of 12 inches and is 4.0 inches deep, the second bowl has a diameter of 10 inches and is 3.5 inches deep, the third bowl has a diameter of 7 inches and is 3.0 inches deep, the sectional bowl has a diameter and a depth which allows it to fit snugly within the third bowl, the elongated elliptical members are each 6.0 inches in length, and the elliptical recessed areas all each have a depth of 0.5 inches.

14. The stackable space saving system of claim 13, wherein the plurality of bowls are fabricated from high-density polyethylene (HDPE) plastic, low-density polyethylene (LDPE) plastic, polyethylene terephthalate (PET/PETE), food-grade polypropylene (PP), polycarbonate (PC), acrylic, nylon acrylic or nylon.

15. A method for saving space when serving food by using the stackable, space saving system of claim 5, said method comprising:

placing the second elliptical central opening atop the top end of the foundation elongated elliptical member;

rotating the second bowl 90 degrees in either direction so that the foundation elongated elliptical member inserts into the second elliptical recessed area so that the second bowl is locked in place on top of the foundation elongated elliptical member of the foundation bowl;

placing the third center elliptical opening of the third bowl atop the top end of the second elongated elliptical member of the second bowl;

rotating the third bowl 90 degrees in either direction so that the second elongated elliptical member inserts into the third elliptical recessed area so that the third bowl is locked in place on top of the second elongated elliptical member of the second bowl;

placing the sectional elliptical central opening of the sectional bowl atop the top end of the third elongated elliptical member of the third bowl; and rotating the sectional bowl 90 degrees in either direction so that the third elongated elliptical member inserts into the sectional elliptical recessed area so that the sectional bowl is locked in place on top of the third elongated elliptical member of the third bowl.

16. The stackable space saving system of claim 10, wherein when the second bowl is locked in place above the foundation bowl, the third bowl is locked in place above the second bowl, and the third elongated elliptical member of the third bowl is inserted into the sectional central elliptical opening of the sectional bowl, the bowls form a three-tiered tower.

17. The stackable space saving system of claim 16, wherein a removable elliptical, elongated member, having the same circumferential dimensions as the sectional central elongated opening, is configured to insert into the sectional central elongated opening.

18. The stackable space saving system of claim 17, wherein when the tower is collapsed, the foundation elongated elliptical member slides into the second elongated elliptical member, the second elongated elliptical member slides into the third elongated elliptical member, and the third elongated elliptical member slides into the sectional elliptical central opening.

19. The stackable space saving system of claim 16, wherein the three-tiered tower is collapsed by rotating the third bowl, which contains the sectional bowl therein, 90 degrees to unlock the second bowl from the third elliptical recessed area so that third bowl sits on top of the front side of the second bowl, and by rotating the second bowl 90 degrees to unlock the foundation bowl from the second elliptical recessed area so that second bowl sits on top of the front side of the foundation bowl.

20. The stackable space saving system of claim 1, wherein each of the plurality of bowls are configured to be used alone, and wherein each of the plurality of bowls has a removable air-tight lid.

* * * * *